US005175920A

United States Patent [19]

Iversen

[11] Patent Number: 5,175,920

[45] Date of Patent: Jan. 5, 1993

[54] BLADE REPLACEMENT TOOL AND METHOD

[76] Inventor: Eugene Iversen, R.R. 2, Box 2365A, Sidney, Mont. 59270

[21] Appl. No.: 764,762

[22] Filed: Sep. 24, 1991

[51] Int. Cl.[5] ..... B23Q 3/00

[52] U.S. Cl. ..... 29/559; 269/46

[58] Field of Search ..... 269/46, 904, 43; 105/150; 254/134.3 R, 134.3 PA; 145/1 A, 1 B; 33/174 G, 187, 188; 248/222.4, 225.1, 223.2, 225.2, 497, 498; 52/547, 543, 551, 556, 125, 105, 748; 29/559

[56] References Cited

U.S. PATENT DOCUMENTS 2,095,295 10/1937 Smith et al. ..... 269/46
2,526,815 10/1950 Glynn ..... 269/46
3,908,962 9/1975 Ross ..... 254/134.3 R
3,953,015 4/1976 Taylor et al. ..... 269/904
4,159,029 6/1979 Matthews ..... 269/904
4,164,346 8/1979 Sickler et al. ..... 269/904
4,254,945 3/1981 Paulson et al. ..... 269/904
4,261,557 4/1981 Johnson ..... 269/46
4,447,049 5/1984 Rudy ..... 269/46

*Primary Examiner*—Robert C. Watson
*Attorney, Agent, or Firm*—Jerry D. Guenther

[57] ABSTRACT

An apparatus and method for transferring the weight of a cutting edge blade to the top of a moldboard for alignment of the cutting edge blade to the moldboard is disclosed. The apparatus includes a roller member with a plurality of rotatably mounted guide rollers, a rigid arm with a hook for engaging the cutting edge blade, and a means of adjusting the roller member on the rigid arm.

3 Claims, 1 Drawing Sheet

BLADE REPLACEMENT TOOL AND METHOD

BACKGROUND OF THE INVENTION

1. Field of the Invention

This invention generally relates to an apparatus and method for transferring the weight of a cutting edge blade to a moldboard for alignment of the cutting edge blade to the moldboard.

2. Description of Related Art

Earth working blades are commonly employed on self-propelled earth moving vehicles, such as graders and tractors. Earth working blades generally consist of many components, including a moldboard and a cutting edge blade. The cutting edge blade becomes worn after a period of use because of the abrasive action of the soil. The common practice is to remove the worn cutting edge blade and replace it with a new one. Cutting edge blades are attached in specific alignment to the moldboard on the bottom of the moldboard by a plurality of nuts and bolts. To replace the cutting edge blade on the moldboard, the new cutting edge blade must be physically placed and held in alignment until the bolts and nuts are in place. A conventional method for aligning the cutting edge blade to the moldboard is to have a workman physically carry the cutting edge blade to a position of close proximity with the moldboard. The cutting edge blade is then physically positioned and held in position while attachment is made. A typical cutting edge blade can weigh as much as 135 pounds. Manual alignment and positioning of the cutting edge blade increases the opportunity for physical injury which is costly and time consuming.

Various apparatus for supporting a weight on a rolling member are known. One such apparatus for transferring a weight of a chain link wire fabric to a top rail of a chain link fence is disclosed in U.S. Pat. No. 4,261,557, issued to Johnson. This apparatus includes a hook means for engaging the chain link wire fabric and weight transfer means for stably transferring the weight of the chain link wire fabric engaged by the hook means to the top rail of the chain link fence, said weight transfer means including a rigid connection to the hook means and a roller member which may roll along the top rail of the chain link fence, which hook means include at least one hook member provided on the same side of the rigid connection as the roller member.

Various apparatus for stringing power lines are known. One such apparatus for stringing power lines is disclosed in U.S. Pat. No. 3,908,962, issued to Ross. This apparatus includes first and second generally C-shaped brackets which are connected to one another and spaced apart by spacers. Connected to an upper portion of the C-shaped brackets is a shaft which supports a pulley, which pulley engages a messenger wire. Mounted in a rotatable manner and suspended from a part which connects a lower portion of the first C-shaped bracket to a lower portion of the second C-shaped bracket, is a generally diamond shaped spacer, which spacer includes three hook-shaped recesses for receiving three wires.

Another such apparatus for fixing a movable frame which can move horizontally to a support frame is disclosed in U.S. Pat. No. 3,891,065 issued to Iijima and Yoshida. This apparatus is characterized by a wedge member being interposed upwardly between a hydraulic cylinder mounted horizontally in the lower portion of a movable frame and a lower guide member so as to be freely rockable. Vertical and horizontal fastening forces fix the movable frame to the support frame.

One problem associated with the replacement of a cutting edge blade is the weight of the cutting edge blade which must be moved and supported in alignment. Another is the size of the cutting edge blade which must be moved and supported in alignment. Still another is the increased opportunity for physical injury in moving, positioning and holding the cutting edge blade in position. Still another is the lack of speed in aligning and attaching the cutting edge blade.

The present invention constitutes an improvement over previous apparatus and methods. What was needed was an apparatus and method for supporting, transferring and holding a cutting edge blade in alignment on a moldboard.

SUMMARY OF THE INVENTION

1. Objects of the Invention

It is the general object of my invention to provide an apparatus for transferring a weight of a cutting edge blade to the top of a moldboard, for allowing a workman to align and position the cutting edge blade on the moldboard quickly and safely.

It is another object of my invention to provide a method for transferring a weight of a cutting edge blade to the top of a moldboard for allowing a workman to align and position the cutting edge blade on the moldboard quickly and easily.

2. Features of the Invention

In keeping with these objects, and others which will become apparent hereinafter, specifically my invention provides an apparatus comprising a roller member which may roll along the top of a moldboard having a frame supporting a plurality of axles which are rigidly attached in spatial relation, a plurality of guide rollers which are rotatably mounted on the plurality of axles, a plurality of parallel ridges across the width of the frame complimentary to the width of a rigid arm for positioning and restricting rotational movement of the rigid arm on the frame, a bolt to support the rigid arm, and a single-wing nut of complimentary size to the bolt and the rigid arm which is longitudinally adjustable in relation to the roller member by means of a longitudinally slotted guide in the rigid arm which is of sufficient size to allow the bolt of the roller member to freely slide therein affording adjustment of the rigid arm in relation to the roller member, which rigid arm has a hook means for engaging the cutting edge blade, and which hook means is provided on the same side of the rigid arm as the roller member.

As can be readily inferred from the heretofore stated description of the invention, the method of the invention is directed to transferring a weight of a cutting edge blade to the top of a moldboard and comprises the steps of:

Engaging a cutting edge blade with a hook means of a rigid arm, which rigid arm is adjustably attached to a roller member, which roller member has a plurality of guide rollers rotatably mounted on a plurality of axles;

Mounting the roller member on a top of a moldboard with the plurality of guide rollers resting on the top of the moldboard and the rigid arm with the engaged cutting edge blade abutting the front of the moldboard;

Rolling the roller member with the rigid arm and engaged cutting edge blade along the top of the moldboard until the cutting edge blade is in alignment for attachment to the moldboard.

BRIEF DESCRIPTION OF THE DRAWINGS

Preferred embodiments of the present invention are described with reference to the accompanying drawings wherein like members bear like reference numbers, and wherein.

DESCRIPTION OF PREFERRED EMBODIMENTS

Figure 1:
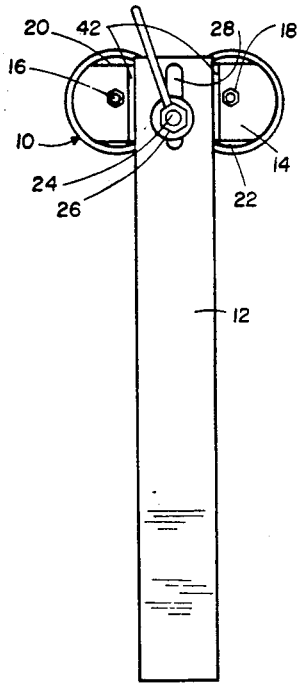
FIG. 1 is a front view of the first preferred embodiment of the apparatus, according to the present invention.
Figure 2:
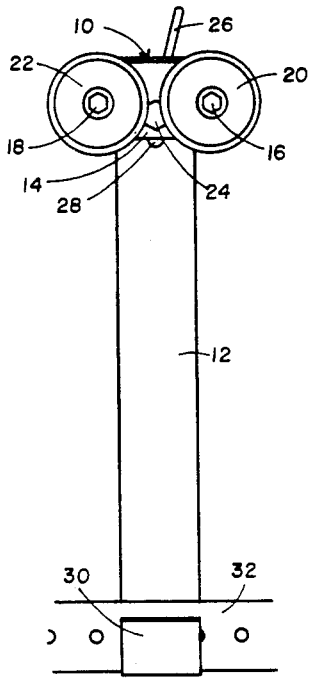
FIG. 2 is a back view of the first preferred embodiment of the apparatus, according to the present invention.
Figure 3:
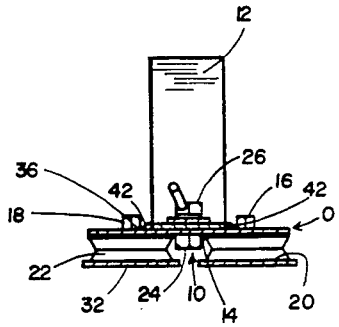
FIG. 3 is a top view of the first embodiment of the apparatus, according to the present invention.

With reference to FIGS. 1 to 3, a first preferred embodiment of the apparatus, according to the present invention, for transferring the weight of a cutting edge blade to the top of a moldboard 40, includes a roller member 10 and a rigid arm 12. By engaging the cutting edge blade 32 by a hook means 30, lifting the apparatus and mounting the roller member 10 on the top of a moldboard 40, the weight of the cutting edge blade 32 is thereby transferred to the top of the moldboard 40. The roller member 10 includes a frame 14 supporting a plurality of axles 16, 18 which are rigidly attached in spatial relation. The roller member 10 further includes a plurality of guide rollers 20, 22 which are rotatably mounted on the plurality of axles 16, 18, a plurality of parallel ridges 42 across the width of the frame 14 complimentary to the width of the rigid arm 12 for positioning and restricting rotational movement of the rigid arm 12 on the frame 14, a bolt 24 to support the rigid arm 12, and a wing-nut 26 of complimentary size to the bolt 24. The rigid arm 12 includes a longitudinally slotted guide 28 which is of sufficient size to allow the bolt 24 of the roller member 10 to freely slide therein affording adjustment of the rigid arm 12 in relation to the roller member 10. The rigid arm 12 further includes a hook means 30 for engaging a cutting edge blade 32, which hook means is provided on the same side of the rigid arm 12 as the roller member 10.

In order to fit onto a top of a standard moldboard 40, the width of the rolling surface of the guide rollers 20, 22 may, for example, be one inch, while the diagonal length 32 of the guide rollers 20, 22 most distant from the frame 14, identified as R1, may, for example be 4 inches, while the diagonal length of the intermediate portion 34 of the guide rollers 20, 22, identified as R3, may, for example, be 3 inches, and the diagonal length 36 of the guide rollers 20, 22 in closest proximity to the frame 14, identified as R2, may, for example be 3¼ inches.

Figure 4:
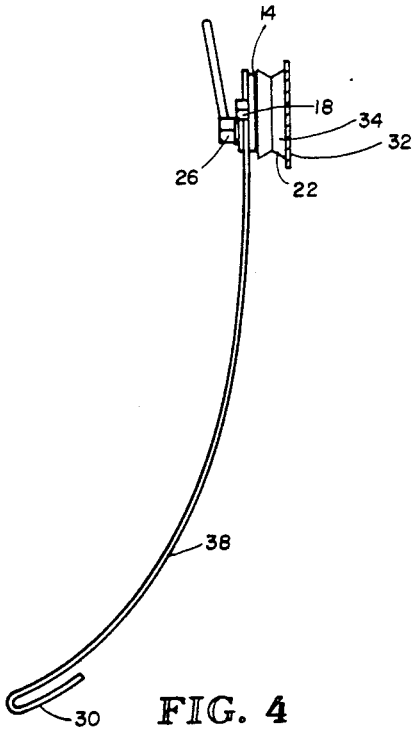
FIG. 4 is a side view of a second embodiment of the apparatus, according to the present invention.
Figure 5:
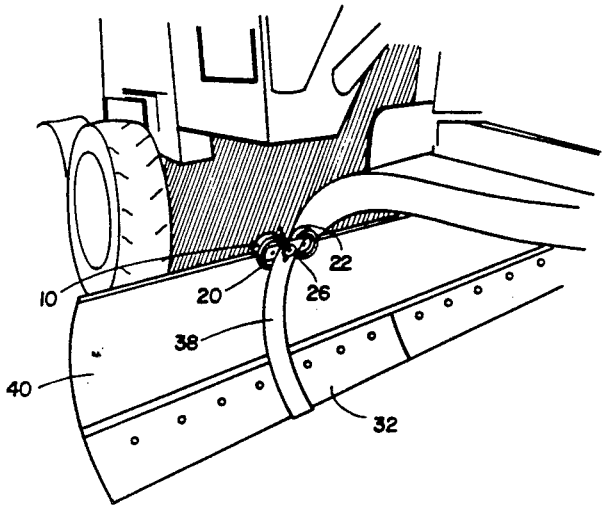
FIG. 5 is a perspective view of the embodiment shown in FIG. 4, illustrating the manner in which the invention is used to transfer a weight of a cutting edge blade to the top of a moldboard.

With reference to FIG. 4, a second embodiment of the apparatus, according to the present invention, includes a generally C-shaped rigid arm 38 which complements the generally C-shaped front of the moldboard 40. The second embodiment of the present invention, like the first embodiment, is inherently stable in use. As shown in FIG. 5, after the cutting edge blade 32 has been engaged by the hook means 30, and after the roller member 10 has been mounted on the top of the moldboard 40, the weight of the cutting edge blade 32 will be suspended from the hook means 30 and transferred to the top of the moldboard 40 through the rigid arm 12 and roller member 10.

Various modifications of the above-described embodiment of the invention will be apparent to those skilled in the art, and it is to be understood that such modifications can be made without departing from the scope of the invention, if they are within the spirit and the tenor of the accompanying claims.

What is claimed is:

1. A method for transferring the weight of a cutting edge blade to a top of a moldboard, comprising the steps of:

(a) engaging a cutting edge blade with a hook means of a rigid arm, which rigid arm is adjustably attached to a roller member, which roller member has a plurality of guide rollers rotatably mounted on a plurality of axles;

(b) mounting the roller member on a top of a moldboard with the plurality of guide rollers resting on the top of the moldboard and the rigid arm with the engaged cutting edge blade abutting a concave side of the moldboard; and (c) rolling the roller member with the rigid arm and the engaged cutting edge blade along the top of the moldboard until the cutting edge is in alignment for attachment to the moldboard.

2. A method for transferring the weight of a cutting edge blade to a top of a moldboard, comprising the steps of:

(a) engaging a cutting edge blade with a hook of a substantially C-shaped rigid arm, which C-shaped rigid arm is attached to a roller member, which roller member has a plurality of guide rollers rotatably mounted on a plurality of axles;

(b) mounting the roller member on a top of a moldboard with the plurality of guide rollers resting on the top of the moldboard and the C-shaped rigid arm with the engaged cutting edge blade complementing and abutting a concave side of a moldboard; and (c) rolling the roller member with the C-shaped rigid arm and engaged cutting edge blade along the top of the moldboard until the cutting edge blade is in alignment for attachment to the moldboard.

3. An apparatus for transferring the weight of a cutting edge blade to a top of a moldboard, comprising:

(a) a roller member which may roll along the top of the moldboard, said roller member having:

(1) a frame supporting a plurality of axles which are rigidly attached in spatial relation;

(2) a plurality of guide rollers, each of said guide rollers having a first cylindrical end having a radius R1, a second cylindrical end having a radius R2, an intermediate portion between the first and second cylindrical ends having a radius of R3;

(3) a plurality of parallel ridges across the width of the frame complimentary to the width of a rigid arm for positioning and restricting movement of a rigid arm on the frame;

(4) a bolt to support a rigid arm; and (5) a single wing-nut of complimentary size to the bolt;

(b) a rigid arm hiving a hook means for engaging the cutting edge blade which rigid arm is positioned and attached to the roller member between the plurality of parallel ridges;

(c) a means of adjusting the rigid arm on the roller member; and (d) the hook means provided on the same side of the rigid arm as the roller member for engaging the cutting edge blade.

* * * * *